US006024602A

United States Patent [19]

Mchugh et al.

[11] Patent Number: 6,024,602

[45] Date of Patent: Feb. 15, 2000

[54] RIGHT ANGLE CARD EDGE CONNECTOR WITH HORIZONTALLY MOUNTED BOARD LOCKS

[75] Inventors: Robert G. Mchugh, Everygreen, Colo.; Wen-Chun Pei, Taipei, Taiwan

[73] Assignee: Hon Hai Precision Ind. Co., Ltd., Taipei Hsien, Taiwan

[21] Appl. No.: 09/006,560

[22] Filed: Jan. 13, 1998

[51] Int. Cl.[7] ..... H01R 13/73

[52] U.S. Cl. ..... 439/567

[58] Field of Search ..... 439/567, 571–573

[56] References Cited

U.S. PATENT DOCUMENTS 5,238,413 8/1993 McCaffrey et al. ..... 439/571
5,551,891 9/1996 Huss, Jr. ..... 439/567

FOREIGN PATENT DOCUMENTS 2643158 9/1977 Germany ..... 439/733.1

*Primary Examiner*—Gary F. Paumen

[57] ABSTRACT

A right angle card edge connector includes a housing having a number of contact passageways defined in a first direction. A number of contacts each have a contact portion fixedly received in a corresponding contact passageway, and a terminal portion perpendicular to the contact portion for connection to a mother board. A number of board lock receiving passages are defined in the housing having openings exposed to rear and bottom sides of the housing. Each passage has a generally L-shaped configuration. A corresponding number of board locks each have a generally L-shaped body portion with a lateral side and a vertical side facing downwards. Two barbs are formed on the lateral side for fixedly engaging with the housing. A pair of legs extend downward from the vertical side for engaging with the mother board. The board locks are mounted to the housing by inserting the board locks into the passages along the first direction. A protective shell is mounted to the housing to protect the terminal portions of the contacts. A spacer is mounted to the housing to accurately space the terminal portions of the contacts from each other a predetermined distance.

9 Claims, 6 Drawing Sheets

RIGHT ANGLE CARD EDGE CONNECTOR WITH HORIZONTALLY MOUNTED BOARD LOCKS

BACKGROUND OF THE INVENTION

1. Field of the Invention

The present invention relates to a right angle card edge connector, particularly to a right angle card edge connector with board locks which are mounted to the connector by horizontally moving the board locks into board lock receiving passages defined in a dielectric housing of the connector.

2. The Prior Art

Card edge connectors generally are classified into two types: a vertical type with straight contacts and a right angle type with right-angled contacts. The conventional right angle type connector is generally mounted to a mother board that contact portions of the contacts thereof for engaging contacts of a mating electrical device extend in a direction parallel to the mother board. Board lock receiving passages in a dielectric housing of the conventional right angle type connector are so defined that board locks are fixed to the housing by inserting the board locks into the board lock receiving passages in a direction perpendicular to the direction that the contact portions extend. To define such board lock receiving passages, the mold for forming the housing requires the use of slides; otherwise, the housing cannot be successfully withdrawn from the cavity of the mold forming the housing.

The use of slides in the plastic mold increases manufacturing costs, and prolongs the fabrication time of the product. Furthermore, the slides are prone to wear and do not produce consistent results since they are movable components, rather than fixed in the mold.

Hence, an improved right angle type electrical connector is needed to eliminate the above mentioned defects of current right angle type electrical connectors.

SUMMARY OF THE INVENTION

Accordingly, an objective of the present invention is to provide a right angle card edge connector having a dielectric housing defining contact passageways for receiving contacts and board lock receiving passages for receiving board locks. The housing is formed by plastic molding in which the mold for forming the housing does not require the use of slides to form the board lock receiving passages.

Another objective of the present invention is to provide a right angle card edge connector having a housing with contact passageways extending in a first direction, board lock receiving passages and board locks, wherein the board locks are mounted to the housing by inserting the board locks into the board lock receiving passages along the first direction.

A further objective of the present invention is to provide a board lock for fixing a connector to a mother board, wherein the board lock can be easily inserted into a board lock receiving passage defined in a housing of the connector for achieving a secure engagement with the housing.

To fulfill the above mentioned objectives, according to one embodiment of the present invention, a right angle card edge electrical connector with a raised height includes a dielectric housing having a front face for engaging with a mating electrical device, a rear face opposite the front face and a number of contact passageways defined in a first direction from the front face to the rear face. Three connector mounting blocks for mounting the connector to a mother board are formed extending downward from the housing. Each mounting block defines a generally L-shaped board lock receiving passage opening to a rear face and a bottom face of the corresponding mounting block. A number of contacts each have a contact portion fixedly received in a corresponding contact passageway for electrically engaging with the mating electrical device, and a terminal portion perpendicular to the contact portion extending behind the rear face of the housing for connection to the mother board. Three board locks each have an L-shaped body portion having a lateral side and a vertical side facing downwards. Two barbs of different height are formed on the lateral side of the body portion wherein the barb with a shorter height will first engage with the housing when the board lock is inserted into the board lock receiving passage along the first direction. Two board locking legs extend downward from the vertical side of the body portion, wherein each leg has a side protrusion formed thereon extending opposite directions for engaging with the mother board. Two protective posts also extend downward from the vertical face of the body portion beside the mounting legs to prevent damage from occurring to an upper portion of the legs near the vertical face, wherein one post also functions to guide the insertion of the legs into the corresponding contact receiving passage. The connector also includes a protective shell for enclosing the terminal portions of the contacts, and a spacer for accurately spacing the terminal portions from each other a predetermined distance.

DETAILED DESCRIPTION OF THE PREFERRED EMBODIMENTS

Reference will now be made in detail to the preferred embodiment of the present invention.

Figure 1:
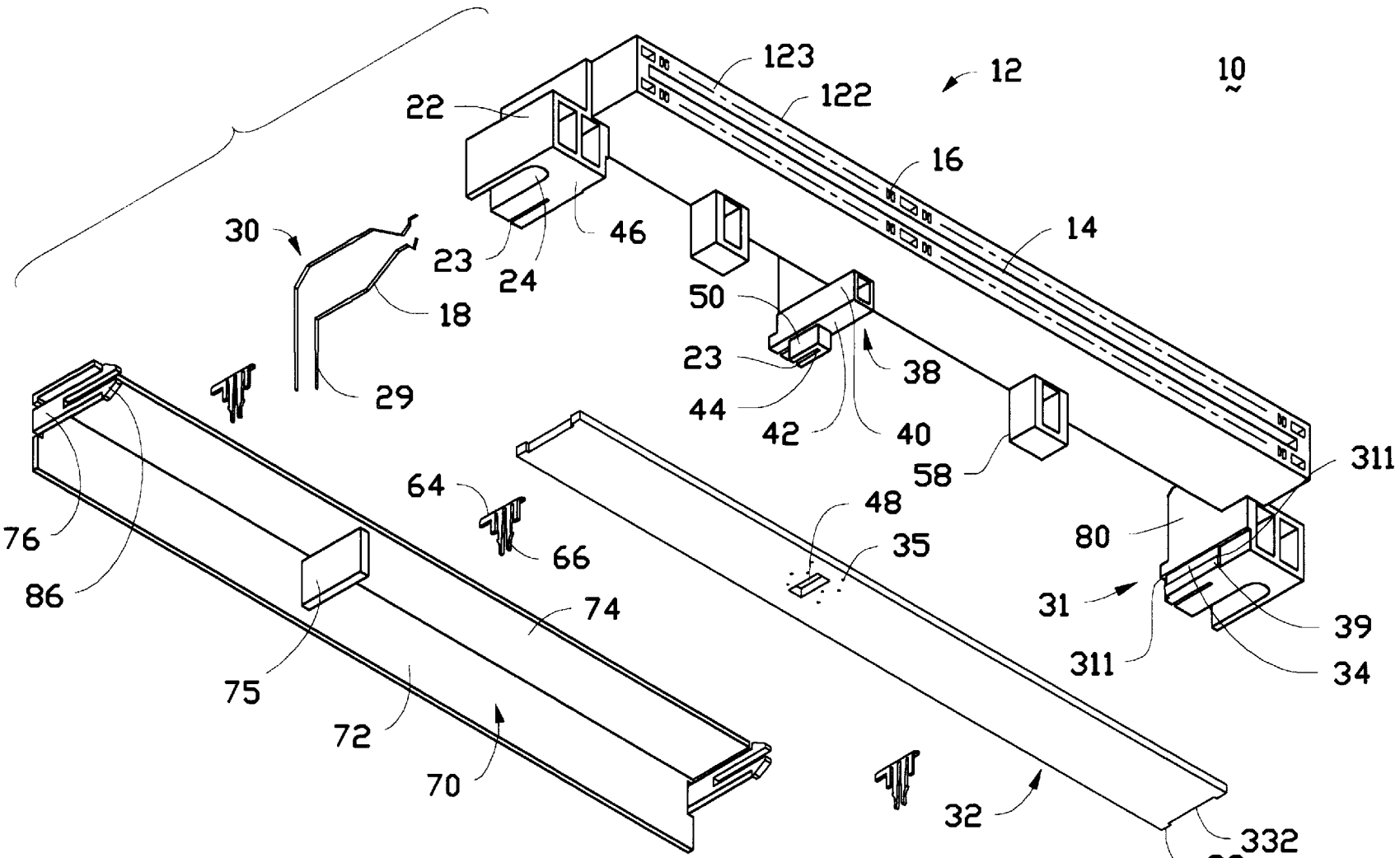
FIG. 1 is an exploded, perspective view of a right angle card edge connector in accordance with the present invention.
Figure 2:
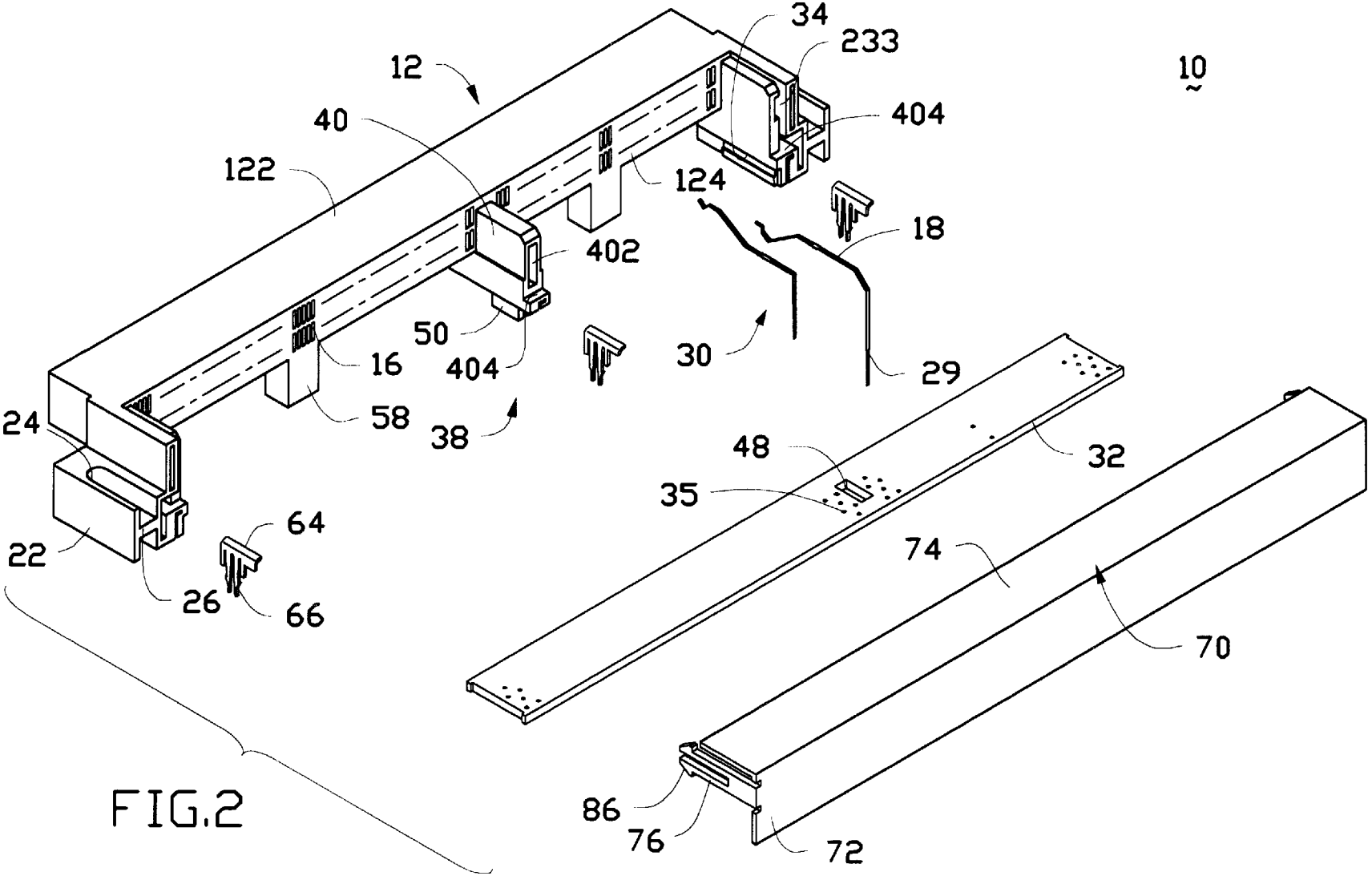
FIG. 2 is a view similar to FIG. 1 taken from a different direction.

Referring to FIGS. 1 and 2, a right angle card edge electrical connector 10 with a raised height is shown. The connector 10 includes a dielectric housing 12, a number of contacts 30 (only two being shown), a spacer 32, three board locks 64, and a protective shell 70. The housing 12 has a main body 122 with a front face 123 defining a slot 14 for receiving an electrical card, a rear face 124 opposite the front face 123 and a number of contact passageways 16 defined from the front face 123 to the rear face 124. Two end mounting blocks 22 are integrally formed at two lateral sides of the main body 122 and extend laterally and downwards therefrom. Each end mounting block 22 has a bottom face 46 for connecting to a mother board (not shown), a board lock receiving passage 23, a web 26 (FIG. 2) in a slot 24 for extension of a screw (not shown) therethrough for fixing the connector 10 to the mother board, and an inner face 80. At a lower portion of the inner face 80, each end mounting block 22 forms a spacer locking seat 31 having a spacer guiding portion 39 with a slanted face inclining inwardly and upwardly from the bottom of the end mounting block 22, and a spacer engaging portion 34 depressed from a top edge of the guiding portion 39 a distance. The engaging portion 34 forms two spacer engaging edges 311 at two lateral sides thereof, respectively. Each end mounting block 22 further defines a protective shell mounting hole 233 located above the spacer locking seat 31.

A middle mounting block 38 is formed on a middle portion of the main body 122 of the housing 12. The middle mounting block 38 has a large upper block 40 forming a bottom face 42 and defining a protective shell locating hole 402 with an opening exposed to the rear face of the housing and a small spacer engaging block 50 extending downward from the bottom face 42 of the upper block 40. The spacer engaging block 50 has a bottom face 44 for connection to the mother board (not shown). The middle mounting block 38 defines a board lock receiving passage 23 from a rear edge of the upper block 40 to the spacer engaging block 50.

The housing 12 is further formed with two rectangular locating posts 58 projecting downwards from a bottom face (not labeled) of the main body 122 of the housing 12 and extending beyond the end and middle mounting blocks 22, 38 for fittingly extending through two locating holes defined in the mother board (not shown) when the connector 10 is mounted to the mother board.

Each contact 30 has a contact portion 18 for engaging with contact pads (i.e. gold fingers) on the mating electrical card (not shown), and a terminal portion 29 for being soldered to the mother board (not shown). The contact and terminal portions 18, 29 are perpendicular to each other.

The spacer 32 defines a middle rectangular hole 48 and a number of round bores 35 for receiving the terminal portions 29 of the contacts 30 thereby accurately spacing the terminal portions 29 from each other a predetermined distance. The spacer 32 has two lateral sides (not labeled) each forming a pair of engaging jaws 33 and defining a recess 332 therebetween.

Figure 3:
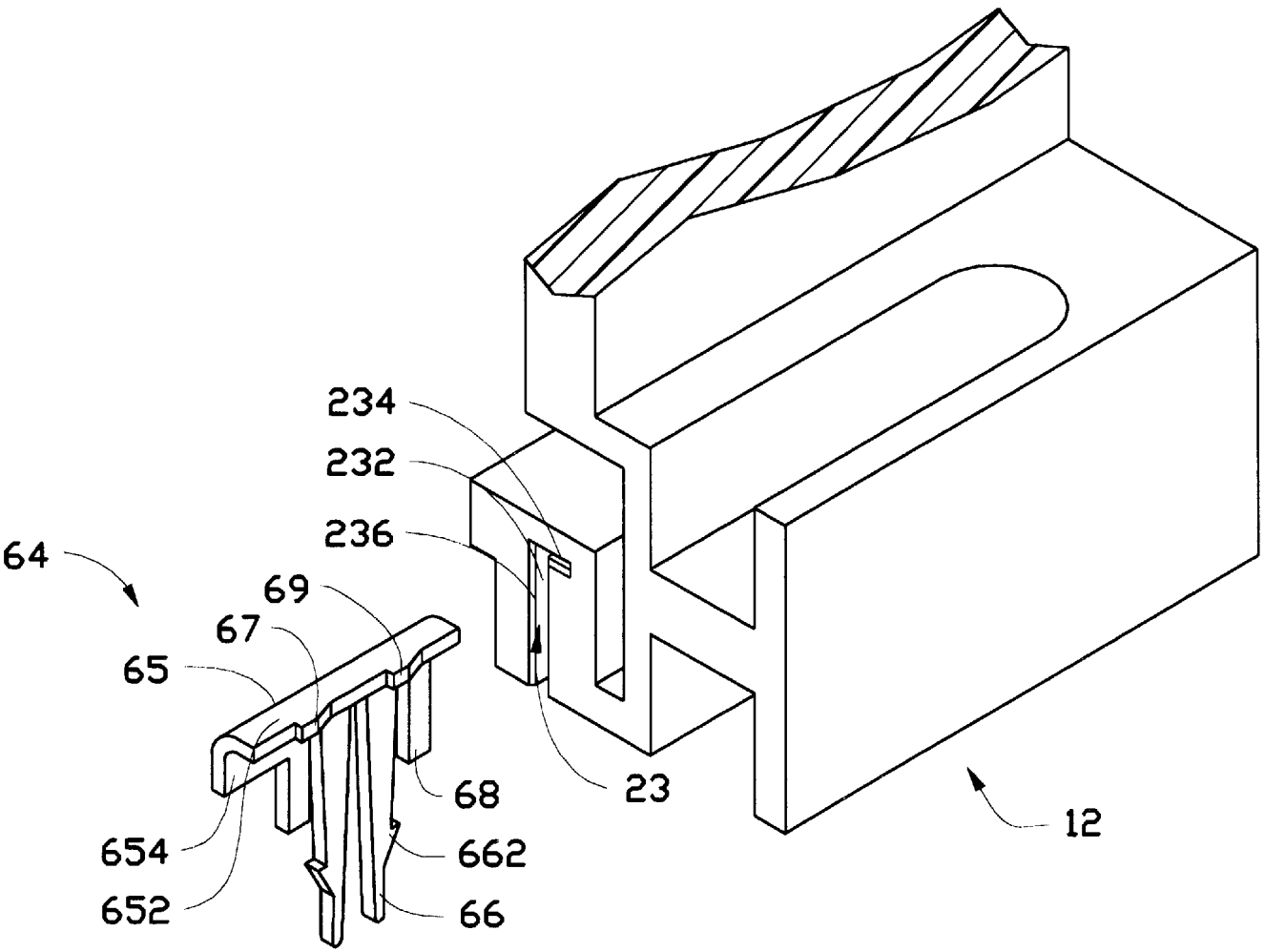
FIG. 3 is a partial, enlarged perspective view showing the detail of a board lock and a board lock receiving passage defined in a dielectric housing of the connector.

Also referring to FIG. 3, each board lock 64 has an L-shaped body portion 65 with a horizontal side 652 and a vertical side 654. A pair of board locking legs 66 extend downwards from the vertical side 654. The locking legs 66 each have a board locking protrusion 662 formed thereon projecting from lower portions thereof and extending in opposite directions. Two connector housing engaging barbs 67, 69 are formed on the horizontal side 652 of each board lock 104, wherein the front barb 69 has a height smaller than that of the rear barb 67. By such design, the board lock 64 can be easily inserted into the board lock passage 23 to achieve a secure engagement with the housing 12 thereby fixedly mounting the board lock 64 to the housing 12. Two leg protective posts 68 are formed extending downward from the vertical side 654 adjacent to the locking legs 66. In addition to protecting the legs 66 from an adverse bending or impact force acting on an upper portion thereof, the front post 68 also functions as a guide to assist the insertion of the legs 66 into the corresponding board lock receiving passage 23. The board locks 23 are made from a metal sheet by a continuous stamping operation.

The L-shaped board lock receiving passage 23 consists of a vertical and horizontal portion 232, 234 having dimensions conforming to a thickness of the board lock 64, whereby the board lock 64 can be matingly fitted into the passage 23 to reach a locking position wherein a front end of the board lock 64 confronts an inner-most end (not shown) of the passage 23, and the barbs 69, 67 interferentially engage with the housing 12. A chamfer 236 is formed around a rear opening of the passage 23 to facilitate the insertion of the board lock 64 into the passage 23. Since the passages 23 are defined having an opening entirely exposed to the rear faces (not labeled) of the mounting blocks 22, 38 in the same direction that the contact passageways 16 are defined, the mold (not shown) for forming the housing 12 does not require the use of slides to define the board lock receiving passages 23 thereby facilitating the successful removal of the formed housing 12 from a cavity of the mold forming the housing 12. The board locks 64 are mounted to the housing 12 by horizontally inserting the board locks 64 into the corresponding board lock receiving passages 23. The passages 23 are so defined that they also have openings exposed to bottom faces 46, 44 of the end and middle mounting blocks 22, 38, respectively, whereby when the board locks 23 are mounted to the housing 10, the leg portions 66 thereof extend downward from the bottom faces 46, 44 of the end and middle mounting blocks 46, 48 to engage with the mother board (not shown) by the protrusions 662.

The protective shell 70 is formed to have a top cover 74 and a rear wall 72 perpendicular to the top cover 74. Two mounting arms 76 extend forward from two lateral sides of the rear wall 72, wherein each arm 76 forms a pair of engaging hooks 86. A rectangular locating plate 75 is formed near a middle portion of the shell 70 in contact with the top cover 74 and the rear wall 72.

To assemble the connector 10, the contacts 30 are first mounted to the housing 12 by extending the contact portions 18 thereof into the contact passageways 16 from the rear face 124 of the main body 122 of the housing 12 to reach a position, wherein the contact portions 30 are fixedly received in the contact passageways 16 and the terminal portions vertically extend behind the rear face 124 of the housing 12.

Figure 4:
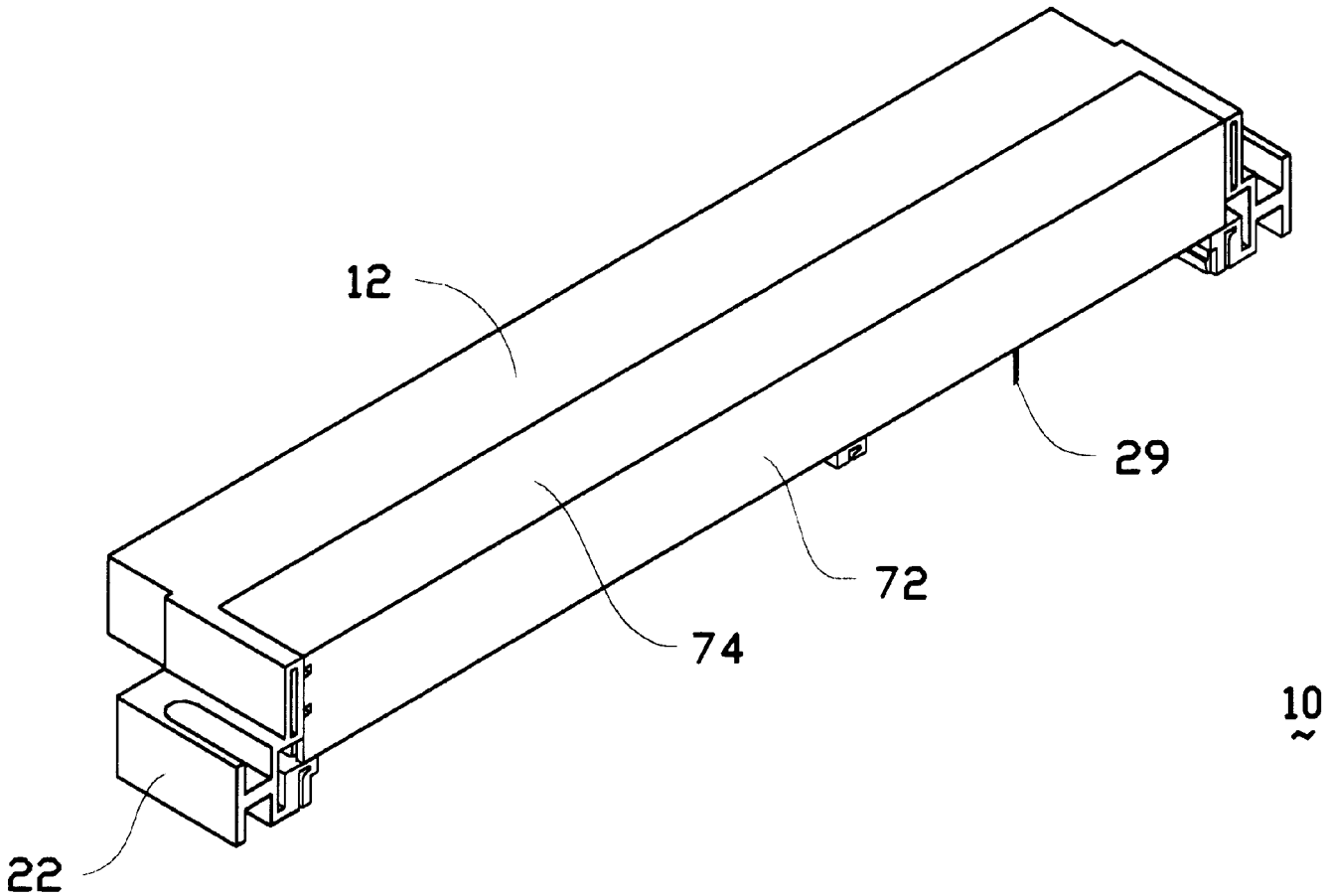
FIG. 4 is an assembled perspective view of the dielectric housing, contacts and a protective shell.

Thereafter, the protective shell 70 is mounted to the housing 12 by extending each mounting arm 76 into the corresponding mounting hole 233 and the locating plate 75 into the locating hole 402 to reach a position as shown in FIG. 4, in which each pair of the engaging hooks 86 are engaged with two steps (not shown) formed in the mounting holes 233. A front edge (not labeled) of the top cover 74 abuts the rear face 124 of the main body 122 of the housing 12. A bottom edge (not labeled) of the rear wall 72 rests on supporting faces 404 (best seen in FIG. 2) each formed by the end and middle mounting blocks 22, 38, respectively. Therefore, the exposed terminal portions 29 of the contacts 30 are protected by the top cover 74 and the rear wall 72 so that the terminal portions 29 will not be damaged during transportion/handling of the connector 10.

Afterwards, the board locks 64 are mounted to the housing 12 by inserting the board locks 64 into the corresponding board lock receiving passages 23 in a manner as mentioned above to reach the position as shown in FIGS. 5 and 6.

Figure 5:
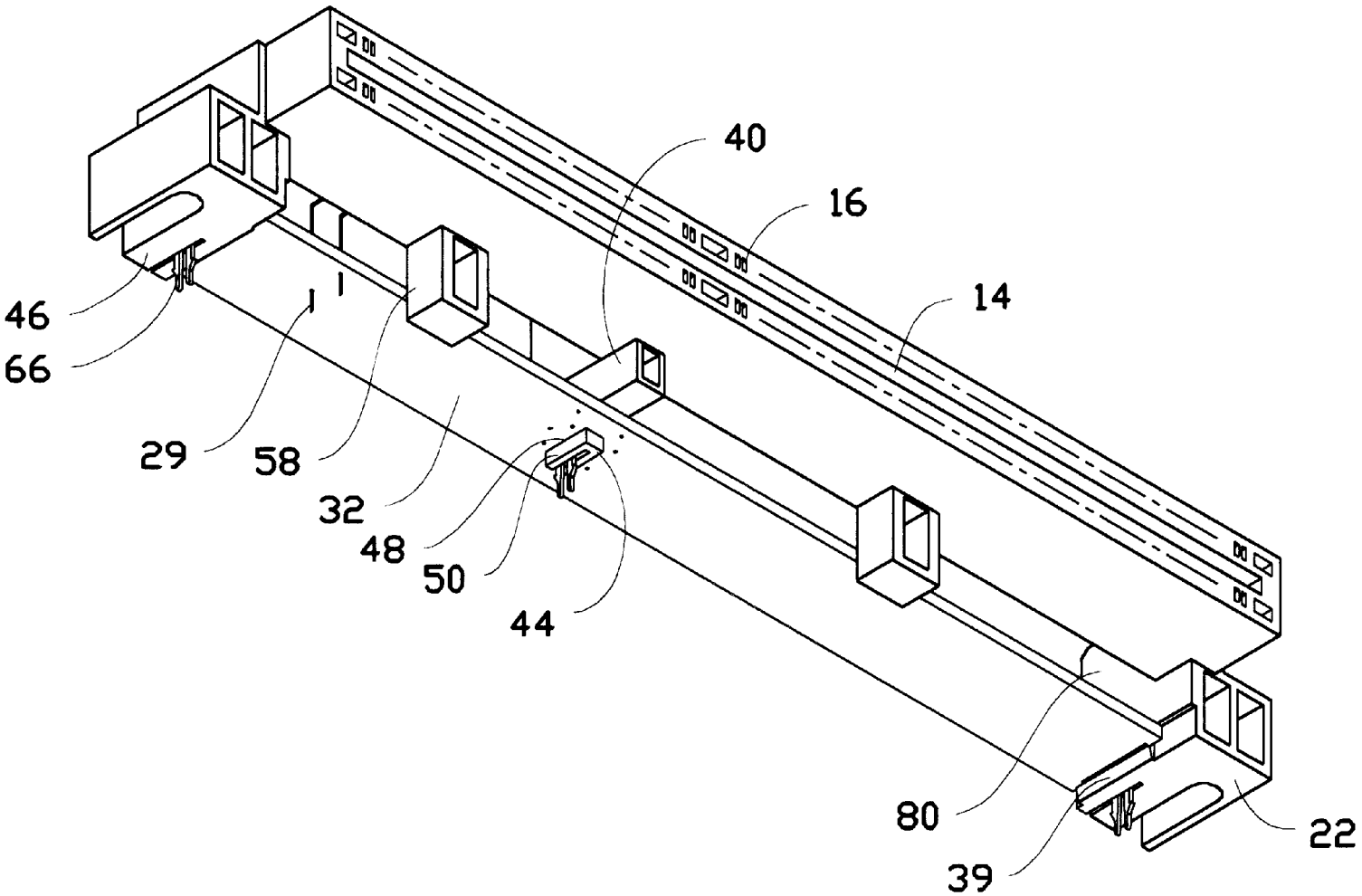
FIG. 5 is an assembled perspective view of all the components constituting the present invention.
Figure 6:
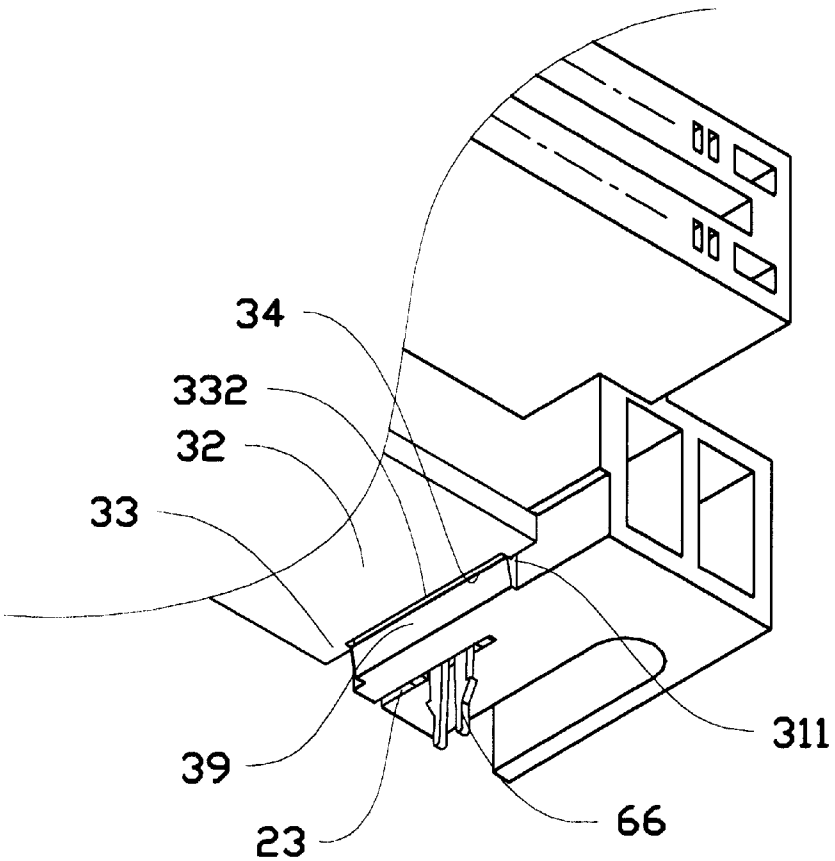
FIG. 6 is a partial, enlarged perspective view showing the detail of a spacer and the board lock mounted to the dielectric housing of the connector.

Finally, also referring to FIGS. 5 and 6, the spacer 32 is mounted to the housing 12 by moving the rectangular hole 48 onto the spacer engaging block 50 and each lateral side of the spacer 32 across the inclined face of the spacer guiding portion 39 of the corresponding spacer locking seat 31 from the bottom thereof to reach a position in which the spacer engaging portion 34 is engagably received in the recess 332 and the jaws 33 fixedly engage with the corresponding spacer engaging edges 311. When the spacer 32 is mounted to the housing 12, bottom ends of the terminal portions 29 of the contacts 30 extend through the corresponding bores 35 defined in the spacer 32, whereby the terminal portions 29 are accurately spaced from each other a predetermined distance.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

We claim:

1. A board lock for fixing an electrical connector to a mother board, comprising:

a body portion having a lateral side and a vertical side substantially perpendicular to the lateral side;

electrical connector housing engaging means for interferentially engaging with a dielectric housing of the connector to fix the board lock to the housing, said housing engaging means being connected to the lateral side and extending in a first direction;

mother board connecting means for engaging with the mother board to fix the connector to the mother board, said connecting means being connected to the vertical side and extending in a second direction substantially perpendicular to the first direction, the connecting means comprising a pair of legs extending from the vertical side of the body portion, each leg forming a side protrusion for fixedly engaging with the mother board; and a post extending from the vertical side of the body portion adjacent to the legs, whereby the legs can be easily inserted into a board lock receiving passage defined by the dielectric housing of the connector, the pair of legs and the post being flat and lying in the same plane.

2. The board lock in accordance with claim 1, wherein the body portion has a substantially L-shaped configuration.

3. The board lock in accordance with claim 1, wherein the engaging means comprises a barb-like structure.

4. The board lock in accordance with claim 1, wherein the engaging means comprises two barb-like structures with different heights projecting from the lateral side of the body portion.

5. The board lock in accordance with claim 1 further comprising a pair of posts extending from the vertical side of the body portion beside the legs to protect a portion of the legs near the vertical side from an adverse bending or impact force acting thereon.

6. An electrical connector, comprising:

a dielectric housing having a front side for engaging with a mating electrical device, a rear side opposite the front side, a number of contact passageways defined in a first direction from the rear side to the front side, and a board lock receiving passage;

a number of contacts having contact portions fixedly received in the contact passageways for engaging with contacts of the mating electrical device and terminal portions perpendicular to the contact portions for connection to a mother board;

a board lock fixed to the housing by moving the board lock into the board lock receiving passage along the first direction; and wherein the board lock receiving passage has a rear opening entirely exposed to the rear side of the housing, the board lock receiving passage also having a bottom opening exposed to a bottom face of the housing, the board lock receiving passage having an L-shaped configuration having a width substantially the same as a thickness of the board lock, the board lock comprising an L-shaped body portion having a lateral side and a vertical side substantially perpendicular to the lateral side, a connector housing engaging means connected to the lateral side for interferentially engaging with the housing to fix the board lock to the housing, and a mother board engaging means connected to the vertical side and extending through the bottom opening of the board lock receiving passage for engaging with the mother board to fix the connector to the mother board, the mother board engaging means comprising a pair of legs extending from the vertical side of the L-shaped body portion of the board lock, said legs comprising protrusions extending in opposite directions for engaging with the mother board, the board lock further comprising a post extending from the vertical side of the L-shaped body portion and located adjacent to one of the legs, the post entering the board lock receiving passage prior to the entrance of the legs thereinto when the board lock is inserted into the passage along the first direction, the pair of legs and the post being flat and lying in the same plane.

7. The electrical connector in accordance with claim 6, wherein a chamfer is formed around the rear opening of the board lock receiving passage to facilitate the insertion of the board lock into the board lock receiving passage.

8. The electrical connector in accordance with claim 6, wherein the connector housing engaging means comprises two barbs interferentially engaging with the housing, the two barbs sequentially engaging with the housing when the board lock is inserted into the board lock receiving passage along the first direction, the barb which is first engaged with the housing is smaller than that the other barb.

9. The electrical connector in accordance with claim 6, wherein the board lock comprises two barbs interferentially engaging with the housing, the two barbs sequentially engaging with the housing when the board lock is inserted into the board lock receiving passage along the first direction, the barb which is first engaged with the housing is smaller than the other barb.

* * * * *